United States Patent [19]

Eriksson

[11] Patent Number: 4,987,598

[45] Date of Patent: Jan. 22, 1991

[54] ACTIVE ACOUSTIC ATTENUATION SYSTEM WITH OVERALL MODELING

[75] Inventor: Larry J. Eriksson, Madison, Wis.

[73] Assignee: Nelson Industries, Stoughton, Wis.

[21] Appl. No.: 518,569

[22] Filed: May 3, 1990

[51] Int. Cl.[5] ..... G10K 11/16; H04R 1/28

[52] U.S. Cl. ..... 381/71

[58] Field of Search ..... 381/71, 73.1

[56] References Cited

U.S. PATENT DOCUMENTS

| | | | |
|---|---|---|---|
| 4,480,333 | 10/1984 | Ross | 381/71 |
| 4,677,676 | 6/1987 | Eriksson | 381/71 |
| 4,677,677 | 6/1987 | Eriksson | 381/71 |
| 4,736,431 | 4/1988 | Allie et al. | 381/71 |
| 4,783,817 | 11/1988 | Hamada et al. | 381/71 |
| 4,815,139 | 3/1989 | Eriksson et al. | 381/71 |
| 4,837,834 | 6/1989 | Allie | 381/71 |

OTHER PUBLICATIONS

"Adaptive Active Noise Control: Structures, Algorithms and Convergence Analysis", Wei Ren and P. R. Kumar, Inter-Noise 89, Dec. 4–6, 1989, Newport Beach, CA, pp. 435–440.

"Adaptive Vibration Control Using An LMS-Based Control Algorithm", Scott D. Sommerfeldt and Jiri Tichy, Inter-Noise 89, Dec. 4–6, 1989, Newport Beach, CA, pp. 513–518.

"Adaptive Signal Processing", Widrow and Stearns, Prentice-Hall, Englewood Cliffs, NJ, 1985, pp. 100, 101.

"Active Sound Attenuation Using Adaptive Digital Signal Processing Techniques", Larry John Eriksson, Ph.D. Thesis, 1985, University of Wisconsin, Madison, p. 19.

*Primary Examiner*—Jin F. Ng

*Assistant Examiner*—Sylvia Chen

*Attorney, Agent, or Firm*—Andrus, Sceales, Starke & Sawall

[57] ABSTRACT

An active acoustic attenuation system (200) has a first adaptive filter model M modeling the acoustic path P from an input transducer (10) to an output transducer (14), and a second adaptive filter model Q modeling the overall system from the input transducer (10) to an error transducer (16). A third adaptive filter model T models the transfer function S of the output transducer (14) and the error path E between the output transducer (14) and the error transducer (16), without an auxiliary random noise source.

23 Claims, 1 Drawing Sheet

ACTIVE ACOUSTIC ATTENUATION SYSTEM WITH OVERALL MODELING

BACKGROUND AND SUMMARY

The invention relates to active acoustic attenuation systems, and provides overall system modeling.

The invention particularly arose during continuing development efforts relating to the subject matter shown and described in U.S. Pat. No. 4,677,676, incorporated herein by reference. The invention also arose during continuing development efforts relating to the subject matter shown and described in U.S. Pat. Nos. 4,677,677, 4,736,431, 4,815,139, and 4,837,834, incorporated herein by reference.

Active attenuation involves injecting a canceling acoustic wave to destructively interfere with and cancel an input acoustic wave. In an active acoustic attenuation system, the output acoustic wave is sensed with an error transducer such as a microphone which supplies an error signal to a control model which in turn supplies a correction signal to a canceling transducer such as a loud speaker which injects an acoustic wave to destructively interfere with the input acoustic wave and cancel same such that the output acoustic wave or sound at the error microphone is zero or some other desired value. The acoustic system is modeled with an adaptive filter model having a model input from an input transducer such as a microphone, and an error input from the error microphone, and outputting the noted correction signal to the canceling speaker. The model models the acoustic path from the input transducer to the output transducer.

In one aspect of the present invention, a second model models the overall acoustic path from the input transducer to the error transducer, including the portion of the path from the input transducer to the output transducer and also including the portion of the path from the output transducer to the error transducer. The second model has a model output combined with the output of the error transducer to provide an error signal to the error input of the second model.

In another aspect, a third model models the speaker transfer function and the error path. The third model has a model output combined with the model output of the second model to provide a second error signal, which second error signal is combined with the first error signal from the error transducer to yield a third error signal which is provided as the error signal to the error input of each of the second and third models.

DETAILED DESCRIPTION

Figure 1:
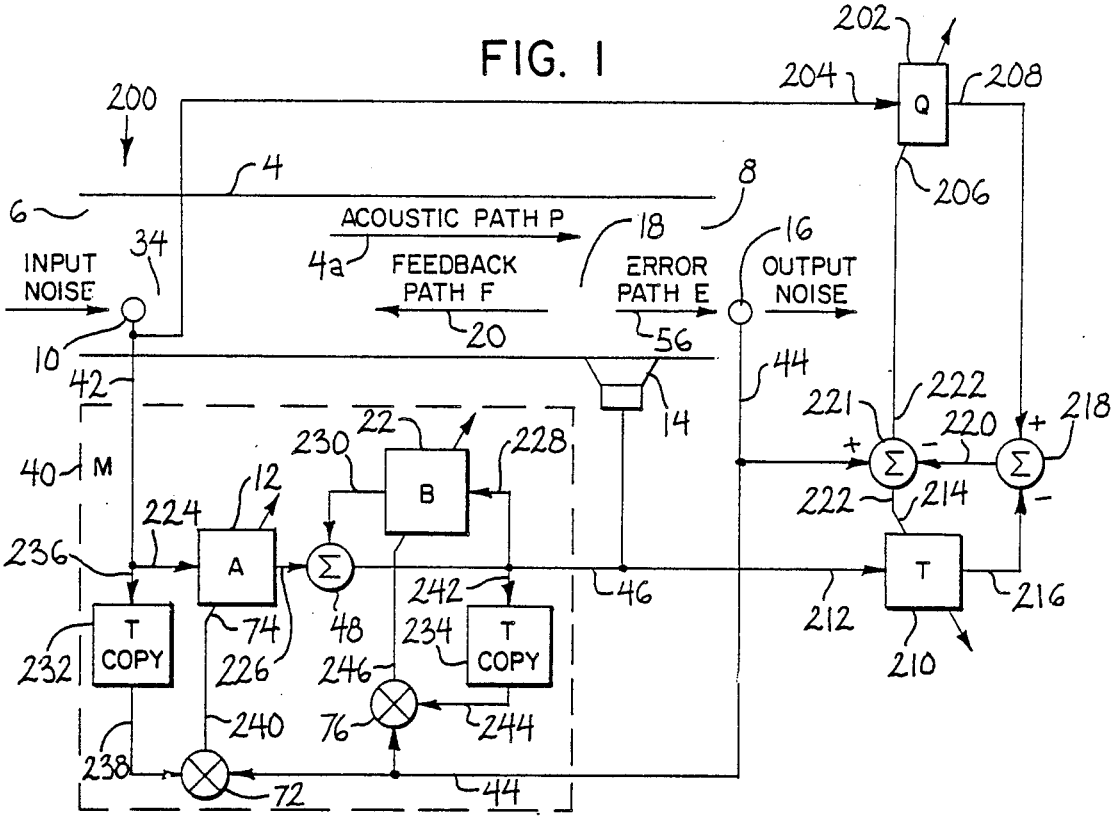
FIG. 1 is a schematic illustration of an active acoustic attenuation system in accordance with the invention.
Figure 2:
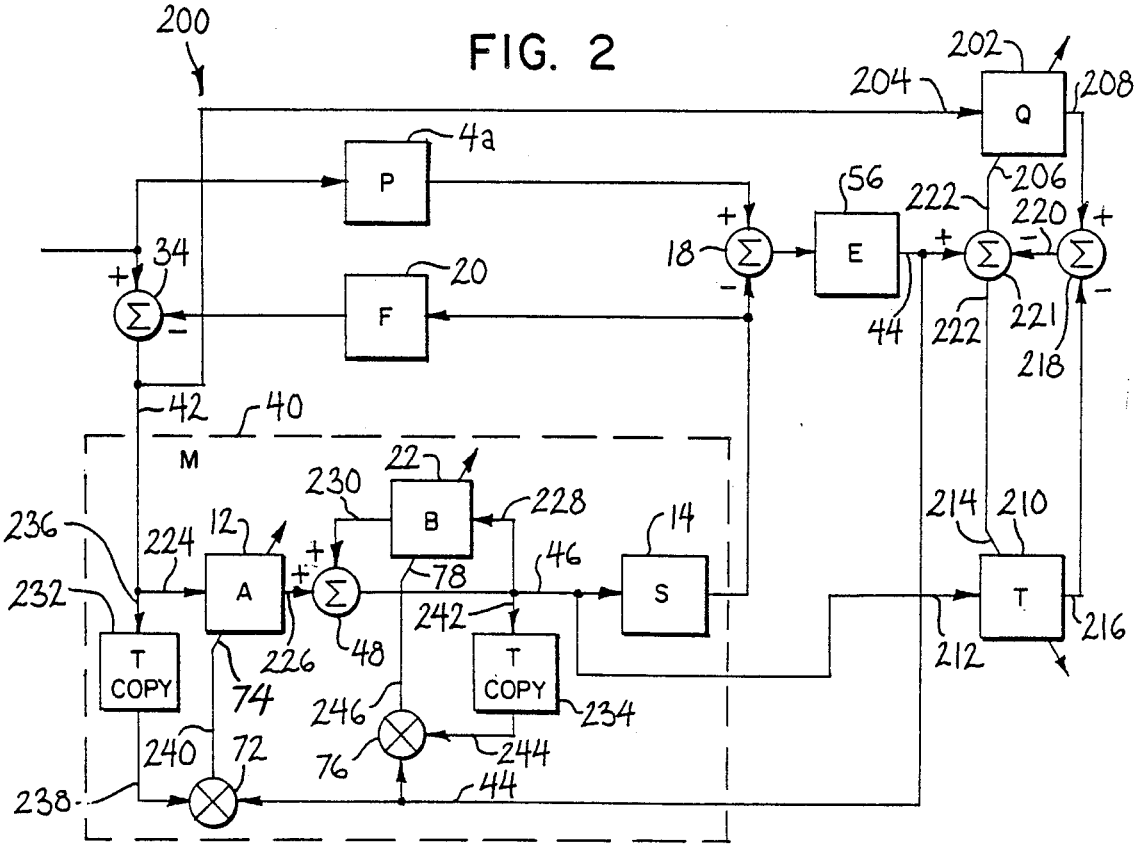
FIG. 2 is a block diagram of the system of FIG. 1.

FIG. 1 shows an active acoustic attenuation system 200 using like reference numerals from incorporated U.S. Pat. No. 4,677,676 where appropriate to facilitate understanding. System 200 includes a propagation path or environment such as within or defined by a duct or plant 4 having an input 6 for receiving an input acoustic wave, or noise, and an output 8 for radiating or outputting an output acoustic wave, or noise. An input transducer such as input microphone 10 senses the input acoustic wave. An output transducer such as canceling speaker 14 introduces a canceling acoustic wave to attenuate the input acoustic wave and yield an attenuated output acoustic wave. An error transducer such as error microphone 16 senses the output acoustic wave and provides an error signal at 44. Adaptive filter model M at 40 combined with output transducer 14 adaptively models the acoustic path from input transducer 10 to output transducer 14. Model M has a model input 42 from input transducer 10, an error input 44 from error transducer 16, and a model output 46 outputting a correction signal to output transducer 14 to introduce the canceling acoustic wave. Output transducer 14 has a transfer function S, FIG. 2. Output transducer 14 is spaced from input transducer 10 along an acoustic path P at 4*a*. Error transducer 16 is spaced from output transducer 14 along an error path E at 56, all as in incorporated U.S. Pat. No. 4,677,676.

In the present invention, in combination, a second adaptive filter model Q at 202 models the acoustic path from input transducer 10 to error transducer 16. Model Q has a model input 204 from input transducer 10, an error input 206, and a model output 208 combined with the output 44 from error transducer 16 to provide an error signal to error input 206 of model Q.

A third adaptive filter model T at 210 adaptively models S and E. Model T has a model input 212 from the output 46 of model M, an error input 214, and a model output 216 combined with the output 44 of error transducer 16 to provide an error signal to the error input 214 of model T.

Model outputs 208 and 216 of models Q and T are combined, and the result thereof is combined with the output 44 of error transducer 16 to provide the error signal to each of models Q and T. A first summer 218 subtractively sums the model outputs 208 and 216 of models Q and T to yield a first output sum at 220. A second summer 221 subtractively sums output 44 of error transducer 16 and output sum 220 to yield a second output sum 222 which is provided as the error signal to the error input of each of models Q and T.

As in incorporated U.S. Pat. No. 4,677,676, model M is preferably an adaptive recursive filter having a transfer function with both poles and zeros. Model M is provided by a recursive least-mean-square filter having an LMS filter A at 12, and another LMS filter B at 22. Adaptive model M uses filters A and B combined with output transducer 14 to adaptively model both the acoustic path P at 4*a* and feedback path F at 20 from output transducer 14 to input transducer 10. The canceling acoustic wave from output transducer 14 is summed with the input acoustic wave as shown at summer 18, FIG. 2, and also travels back leftwardly along the feedback path and is summed at summer 34 with the input acoustic wave adjacent input transducer 10, as in incorporated U.S. Pat. No. 4,677,676. The output acoustic wave is minimized when the error signal 44 approaches zero, as in incorporated U.S. Pat. No. 4,677,676, when P equals AS, equation 1, $$P = AS \qquad \text{(equation 1)}$$

and B equals ASF, equation 2.

$$B = ASF \qquad \text{(equation 2)}$$

It is well known, as in incorporated U.S. Pat. No. 4,677,676, that the proper convergence of model M requires compensation for the transfer functions S and E.

Filter A has a filter input 224 from input transducer 10, a weight update signal 74, and a filter output 226. Filter B has a filter input 228, a weight update signal 78, and a filter output 230. The outputs 226 and 230 of respective filters A and B are summed at summer 48 to yield an output sum at 46. First and second copies of model T are provided at 232 and 234, as in incorporated U.S. Pat. No. 4,677,676 at 144 and 146 in FIG. 20. The T model copy at 232 has an input 236 from input transducer 10, and has an output 238. Outputs 238 and 44 are multiplied at multiplier 72 to yield an output product 240 which is provided as the weight update signal 74 of filter A. The model copy at 234 has an input 242 from output 46, and has an output 244. Multiplier 76 multiplies outputs 244 and 44 to yield an output product 246 which provides the weight update signal 78 of filter B. It is to be understood that although outputs 238 and 244 are scalar signals, the formation of the weight update signals 74 and 78, which are vectors, by multipliers 72 and 76 requires that scalar outputs 238 and 244 be converted to vectors using tapped delay lines or the equivalent prior to multiplication by the error signal 44. This computation of the weight update signal is well known in the art as explained by Widrow and Stearns, *Adaptive Signal Processing,* Prentice-Hall, Englewood Cliffs, NJ, 1985, pages 100, 101, and also "Active Sound Attenuation Using Adaptive Digital Signal Processing Techniques", Larry John Eriksson, Ph.D. Thesis, 1985, University of Wisconsin, Madison, page 19.

A first error signal is provided at 44 by error transducer 16. Model outputs 208 and 216 of respective models Q and T are summed at 218 to yield a second error signal at 220. First error signal 44 and second error signal 220 are summed at 221 to yield a third error signal at 222. The third error signal provides the error input at 206 and 214 of each of models Q and T, respectively. Error signal 222 is the total error signal, which is equal to error signal 44 minus error signal 220, as shown below in equation 3.

$$\text{error signal } 222 = \text{error signal } 44 - \text{error signal } 220 \quad \text{(equation 3)}$$

Error signal 44 is represented by the product of the input noise 6 and transfer function P subtractively summed at summer 18 with transfer function AS/(1−B+FSA) and multiplied by transfer function E, as shown in equation 4.

$$\text{error signal } 44 = \{P - \{AS/(1-B+FSA)\}\}E\{\text{input noise } 6\} \quad \text{(equation 4)}$$

Error signal 220 is represented by the product of the input noise 6 and transfer function Q(1−B)/(1−B+FSA) subtractively summed at summer 218 with transfer function AT/(1−B+FSA), as shown in equation 5.

$$\text{error signal } 220 = \{\{Q(1-B)/(1-B+FSA)\} - \{AT/(1-B+FSA)\}\}\{\text{input noise } 6\} \quad \text{(equation 5)}$$

Substituting equations 4 and 5 into equation 3 yields equation 6.

$$\text{error signal } 222 = \{PE - \{ASE/(1-B+FSA)\} - \{Q(1-B)/(1-B+FSA)\} + \{AT/(1-B+FSA)\}\}\{\text{input noise } 6\} \quad \text{(equation 6)}$$

The overall system modeling provided by Q and T requires that the total error signal 222 be minimized while the modelling provided by A and B requires that the error signal 44 be minimized.

Filter A or T has at least one filter weight, generally the first weight, initialized to a small non-zero value to enable adaptive filter model T to start adapting. Error signal 222 and error signal 44 approach zero and adaptive filters A, B, Q, and T stop adapting when an equilibrium point of the overall system is reached. The equilibrium point for this system requires that filter A and filter B equal the values given in equations 1 and 2, respectively, and that filter Q equals PE/(1−PF), equation 7, $$Q = PE/(1-PF) \quad \text{(equation 7)}$$

and that T equals SE, equation 8, $$T = SE \quad \text{(equation 8)}$$

which results in the error signal 222 and error signal 44 approaching zero. The value of T given by equation 8 is required for the proper convergence of filters A and B. The addition of overall system model Q enables the modelling of S and E by T without an auxiliary random noise source such as 140 in incorporated U.S. Pat. No. 4,677,676. This invention can also be used when there is no feedback present. In this case, the filter B may be omitted, if desired.

It is recognized that various equivalents, alternatives and modifications are possible within the scope of the appended claims. The invention is not limited to acoustic waves in gases, e.g. air, but may also be used for elastic waves in solids, liquid-filled systems, etc.

I claim:

1. An active acoustic attenuation method for attenuating an undesirable acoustic wave, comprising:

sensing an input acoustic wave with an input transducer;

introducing a canceling acoustic wave from an output transducer to attenuate said input acoustic wave and yield an attenuated output acoustic wave;

sensing said output acoustic wave with an error transducer and providing an error signal;

adaptively modeling the acoustic path from said input transducer to said output transducer with a first adaptive filter model having a model input from said input transducer, an error input from said error transducer, and a model output outputting a correction signal to said output transducer to introduce said canceling acoustic wave;

adaptively modeling the acoustic path from said input transducer to said error transducer with a second adaptive filter model having a model input from said input transducer, an error input, and a model output combined with the output of said error transducer to provide an error signal to said error input of said second model.

2. The invention according to claim 1 wherein said output transducer has a transfer function S, and comprising spacing said output transducer from said input transducer along an acoustic path P, spacing said error transducer from said output transducer along an error path E, adaptively modeling S and E with a third adaptive filter model having a model input from the output of said first model, an error input, and a model output combined with the output of said error transducer to provide an error signal to said error input of said third model.

3. The invention according to claim 2 comprising combining the model outputs of said second and third models and combining the result thereof with the output of said error transducer to provide the error signal to each of said second and third models.

4. The invention according to claim 2 comprising summing the model outputs of said second and third models to yield a first output sum, and summing said first output sum and the output of said error transducer to yield a second output sum, and providing said second output sum as the error signal to the error input of each of said second and third models.

5. The invention according to claim 2 comprising providing in said first model a copy of said third model having an input from said input transducer, and an output, and multiplying the output of said copy of said third model and the output of said error transducer to yield an output product, and providing said output product as a weight update signal to said first model.

6. The invention according to claim 5 comprising providing said first model with a transfer function having both poles and zeros.

7. The invention according to claim 6 comprising providing said first model with an adaptive recursive filter.

8. The invention according to claim 7 comprising providing said first model with a recursive least-mean-square filter having an LMS filter A and another LMS filter B, adaptively modeling said acoustic path P and a feedback path F from said output transducer to said input transducer, providing filter A with a filter input from said input transducer, a weight update signal from said output product, and a filter output, and providing filter B with a filter input, a weight update signal, and a filter output, summing the outputs of filters A and B to yield an output sum, providing a second copy of said third model having an input provided by said output sum, and having an output, multiplying the output of said second copy of said third model and the output of said error transducer to yield a second output providing said second output product as a weight update signal to filter B.

9. A method for actively attenuating an undesirable acoustic wave, comprising:

sensing an input acoustic wave with an input transducer;

introducing a canceling acoustic wave from an output transducer to attenuate said input acoustic wave and yield an attenuated output acoustic wave;

sensing said output acoustic wave with an error transducer and providing a first error signal;

providing a first adaptive filter model having a model input from said input transducer, an error input provided by said first error signal, and a model output providing a correction signal to said output transducer to introduce said canceling acoustic wave;

providing a second adaptive filter model having a model input from said input transducer, an error input, and a model output;

providing a third adaptive filter model having a model input from the output of said first model, an error input, and a model output;

combining the model outputs of said second and third models to yield a second error signal;

combining said first and second error signals to yield a third error signal;

providing said third error signal as the error input to each of said second and third models.

10. The invention according to claim 9 comprising summing the model outputs of said second and third models to yield said second error signal, and summing said first and second error signals to yield said third error signal.

11. The invention according to claim 10 wherein the model outputs of said second and third models are subtractively summed, and wherein said first and second error signals are subtractively summed.

12. An active acoustic attenuation system for attenuating an undesirable acoustic wave, comprising:

an input transducer for sensing an input acoustic wave;

an output transducer introducing a canceling acoustic wave to attenuate said input acoustic wave and yield an attenuated output acoustic wave;

an error transducer sensing said output acoustic wave and providing an error signal;

a first adaptive filter model adaptively modeling the acoustic path from said input transducer to said output transducer, said first model having a model input from said input transducer, an error input from said error transducer, and a model output outputting a correction signal to said output transducer to introduce said canceling acoustic wave;

a second adaptive filter model adaptively modeling the acoustic path from said input transducer to said error transducer, said second model having a model input from said input transducer, an error input, and a model output combined with the output of said error transducer to provide an error signal to said error input of said second model.

13. The invention according to claim 12 wherein said output transducer has a transfer function S, said output transducer is spaced from said input transducer along an acoustic path P, said error transducer is spaced from said output transducer along an error path E, and comprising a third adaptive filter model adaptively modeling S and E, said third model having a model input from the output of said first model, an error input, and a model output combined with the output of said error transducer to provide an error signal to said error input of said third model.

14. The invention according to claim 13 wherein the model outputs of said second and third models are combined, and the result thereof is combined with the output of said error transducer to provide the error signal to each of said second and third models.

15. The invention according to claim 13 wherein the model outputs of said second and third models are summed to yield a first output sum, and said first output sum and the output of said error transducer are summed to yield a second output sum, and wherein the error input of each of said second and third models is provided by said second output sum.

16. The invention according to claim 13 wherein said first model includes a copy of said third model having an input from said input transducer, and an output, and wherein the output of said copy of said third model and the output of said error transducer are multiplied to yield an output product, and wherein a weight update signal to said first model is provided by said output product.

17. The invention according to claim 16 wherein said first model has a transfer function with both poles and zeros.

18. The invention according to claim 17 wherein said first model comprises an adaptive recursive filter.

19. The invention according to claim 18 wherein said first model comprises a recursive least-mean-square filter having an LMS filter A and another LMS filter B, wherein filters A and B adaptively model said acoustic path P and a feedback path F from said output transducer to said input transducer, wherein filter A has a filter input from said input transducer, a weight update signal from said output product, and a filter output, and wherein filter B has a filter input, a weight update signal, and a filter output, wherein the outputs of filters A and B are summed to yield an output sum, and comprising a second copy of said third model having an input provided by said output sum, and having an output, and wherein the output of said second copy of said third model and the output of said error transducer are multiplied to yield a second output product, and the weight update signal of filter B is provided by said second output product.

20. An active acoustic attenuation system for attenuating an undesirable acoustic wave, comprising:

an input transducer for sensing an input acoustic wave;

an output transducer introducing a canceling acoustic wave to attenuate said input acoustic wave and yield an attenuated output acoustic wave;

an error transducer sensing said output acoustic wave and providing a first error signal;

a first adaptive filter model having a model input from said input transducer, an error input provided by said first error signal, and a model output providing a correction signal to said output transducer to introduce said canceling acoustic wave;

a second adaptive filter model having a model input from said input transducer, an error input, and a model output;

a third adaptive filter model having a model input from the output of said first model, an error input, and a model output, wherein the model outputs of said second and third models are combined to yield a second error signal, and said first and second error signals are combined to yield a third error signal, and the error input of each of said second and third models is provided by said third error signal.

21. The invention according to claim 20 wherein the model outputs of said second and third models are summed to yield said second error signal, and said first and second error signals are summed to yield said third error signal.

22. An active acoustic attenuation system for attenuating an undesirable acoustic wave, comprising:

an input transducer for sensing an input acoustic wave;

an output transducer having a transfer function S and spaced from said input transducer along an acoustic path P and introducing a canceling acoustic wave to attenuate said input acoustic wave and yield an attenuated output acoustic wave;

an error transducer spaced from said output transducer along an error path E and sensing said output acoustic wave and providing an error signal;

a first adaptive filter model M adaptively modeling said acoustic path P, model M having a model input from said input transducer, an error input from said error transducer, and a model output outputting a correction signal to said output transducer to introduce said canceling acoustic wave;

a second adaptive filter model Q adaptively modeling P and E, model Q having a model input from said input transducer, an error input, and a model output;

a third adaptive filter model T adaptively modeling S and E, model T having a model input from the output of model M, an error input, and a model output;

a first summer summing the model outputs of models Q and T and yielding an output sum providing a second error signal;

a second summer summing said first error signal and said second error signal to yield a second output sum providing a third error signal, wherein the error input of each of models Q and T is provided by said second output sum providing said third error signal.

23. The invention according to claim 22 wherein:

model M comprises a recursive least-mean-square filter having an LMS filter A and another LMS filter B;

filter A has an input from said input transducer, a weight update signal input, and an output;

filter B has an input, a weight update signal input, and an output;

and comprising:

a first copy of model T having an input from said input transducer, and having an output;

a first multiplier multiplying the output of said first copy of model T and said first error signal to yield a first output product, wherein the weight update signal of filter A is provided by said first output product;

a second copy of model T having an input, and an output;

a second multiplier multiplying the output of said second copy of model T and said first error signal to yield a second output product, wherein the weight update signal of filter B is provided by said second output product;

a third summer summing the outputs of filters A and B to yield a third output sum, wherein the input to filter B and the input to said second copy of model T are each provided by said third output sum.

* * * * *